US008141663B2

(12) United States Patent
Lyon et al.

(10) Patent No.: US 8,141,663 B2
(45) **Date of Patent: *Mar. 27, 2012**

(54) DOWN HOLE HAMMER HAVING ELEVATED EXHAUST

(75) Inventors: Leland H. Lyon, Roanoke, VA (US); Warren T. Lay, Catawba, VA (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/183,664

(22) Filed: Jul. 15, 2011

(65) Prior Publication Data

US 2011/0266067 A1 Nov. 3, 2011

(51) Int. Cl.
*E21B 4/14* (2006.01)

(52) U.S. Cl. ..... 175/296

(58) Field of Classification Search ..... 175/296, 175/297, 298; 173/206, 207, 138
See application file for complete search history.

(56) References Cited

U.S. PATENT DOCUMENTS

| | | | | |
|---|---|---|---|---|
| 2,859,733 A | | 11/1958 | Gardner et al. | |
| 2,917,025 A | | 12/1959 | Dulaney | |
| 2,942,578 A | | 6/1960 | Huffman et al. | |
| 2,998,085 A | | 8/1961 | Dulaney | |
| 3,045,768 A | * | 7/1962 | Huffman | 175/100 |
| RE27,434 E | | 7/1972 | Vincent et al. | |
| 4,054,180 A | * | 10/1977 | Bassinger | 173/136 |
| 4,106,571 A | | 8/1978 | Stone | |
| 4,274,497 A | | 6/1981 | Willis et al. | |
| 4,312,412 A | * | 1/1982 | Pillow | 173/17 |
| 4,534,422 A | * | 8/1985 | Rear | 173/206 |
| 4,821,812 A | | 4/1989 | Ditzig | |

(Continued)

FOREIGN PATENT DOCUMENTS

GB 800725 9/1958

(Continued)

OTHER PUBLICATIONS

International Search Report for Application No. PCT/US2010/023742 dated Oct. 29, 2010 (5 pages).

(Continued)

*Primary Examiner* — David Bagnell
*Assistant Examiner* — Kipp Wallace
(74) *Attorney, Agent, or Firm* — Michael Best & Friedrich LLP

(57) ABSTRACT

A percussive assisted rotary drill includes a top sub for connection with a drill pipe. The drill pipe imparts torque to the drill and also supplies motive fluid to the drill. The drill includes a shank adapter to facilitate affixing a rotary drill bit to the drill. The motive fluid is divided between a bit flow which flows through the bit to clear debris at the bottom of the drill, and an actuator flow. An actuator, which may be in the form of a reciprocating piston, moves within the drill under the influence of the actuator flow to impart cyclical blows to the shank adapter. The blows are transferred to the drill bit through the shank adapter to provide a relatively high frequency low amplitude percussive force on the rotating drill bit to assist in the drilling operation. At least a portion of the actuator flow portion of the motive fluid is exhausted through the top end of the drill. The relative flow rates and volumes of the bit and actuator flows can be adjusted with a check valve in the actuator flow exhaust path.

6 Claims, 6 Drawing Sheets

U.S. PATENT DOCUMENTS

| | | | | | |
|---|---|---|---|---|---|
| 4,940,097 | A | * | 7/1990 | Martini | 175/296 |
| 5,085,284 | A | | 2/1992 | Fu | |
| 5,139,095 | A | | 8/1992 | Lyon | |
| 5,143,162 | A | | 9/1992 | Lyon | |
| 5,240,083 | A | | 8/1993 | Lyon | |
| 5,301,761 | A | | 4/1994 | Fu | |
| 5,325,926 | A | | 7/1994 | Lay | |
| 5,562,170 | A | | 10/1996 | Wolfer | |
| 5,566,771 | A | | 10/1996 | Wolfer | |
| 5,682,957 | A | | 11/1997 | Lyon | |
| 5,711,205 | A | | 1/1998 | Wolfer | |
| 5,794,516 | A | | 8/1998 | Wolfer | |
| RE36,848 | E | * | 9/2000 | Bui et al. | 175/65 |
| 6,135,216 | A | | 10/2000 | Lyon | |
| 6,170,581 | B1 | | 1/2001 | Lay | |
| 6,237,704 | B1 | | 5/2001 | Lay | |
| 6,799,641 | B1 | | 10/2004 | Lyon et al. | |
| 7,159,676 | B2 | | 1/2007 | Lyon | |
| 7,467,675 | B2 | | 12/2008 | Lay | |
| 2010/0059284 | A1 | | 3/2010 | Lyon et al. | |

FOREIGN PATENT DOCUMENTS

| | | |
|---|---|---|
| GB | 2181473 | 4/1987 |

OTHER PUBLICATIONS

Written Opinion for Application No. PCT/US2010/023742 dated Oct. 29, 2010 (10 pages).

* cited by examiner

DOWN HOLE HAMMER HAVING ELEVATED EXHAUST

CROSS-REFERENCE TO RELATED APPLICATIONS

This application is a continuation of U.S. patent application Ser. No. 12/369,579, filed Feb. 11, 2009, the content of which is incorporated herein by reference in its entirety.

BACKGROUND

The two most common methods for drilling rock involve either quasi-static loading of rock as used in rotary drilling, or high intensity impact loading as used in down-the-hole (DTH) drilling. DTH applications include a hammer assembly having a piston or actuator that reciprocates within the drill casing and applies a cyclical impact on an anvil. The anvil is typically part of or directly connected to the drill bit so that impact forces of the piston striking the anvil are transferred through the drill bit into the rock being drilled. The piston typically reciprocates in response to motive fluid (e.g., compressed air) alternatingly raising and lowering the piston. All motive fluid is typically exhausted from the drill through the drill bit after actuating the hammer assembly. Exhausting motive fluid through the drill bit clears cuttings and other debris from around the drill bit and carries such debris up out of the hole or bore being drilled. Hybrid rock drills (called percussive assist rotary drills or PARD) that utilize a DTH hammer assembly to impact a rotary drill bit are also known, and also exhaust all motive fluid through the drill bit.

When motive fluid is exhausted through the drill bit, it flows over an exterior surface of the drill bit ("flows over" and variations thereof meaning in this specification that the motive fluid flows across and in contact with the drill bit exterior surface) and up the bore being drilled. In known DTH hammer assemblies having reverse circulation configurations, the motive fluid is actually exhausted above the drill bit, flows down over the drill bit exterior, and then flows up through the center of the drill bit, drill assembly, and drill pipe or drill string to the surface. In this specification, the term "through the bit" and "bit exhaust" are intended to include exhausted motive fluid that flows over the drill bit exterior surface, whether flowing out of the bit and up the bore or flowing in a reverse circulation direction.

In the present application, the terms "down hole hammer," "hammer," and "hammer assembly" refer to a drilling arrangement using the impact forces of a reciprocating piston or other moving actuator, whether such drilling arrangement is present in a DTH application, a PARD arrangement, or another arrangement, and regardless of whether the drilling arrangement includes a standard bit, drag bit, rotary bit, or another cutting surface.

The present invention relates to a down hole hammer that exhausts at least a portion of the motive fluid through a portion of the drill other than the drill bit. For drilling operations in which the drill bit is at or near the bottom of the drill assembly, the invention may be termed a down hole hammer having a portion of motive fluid exhausted above the drill bit or a down hole hammer having elevated exhaust. The invention also relates to a down hole hammer in which motive fluid is divided into a portion that is exhausted through the drill bit or elsewhere such that it flows over a portion of the drill bit's exterior, and a schematically parallel portion that operates the piston and is exhausted above the drill bit such that it does not flow over the drill bit's exterior surface.

SUMMARY

In one embodiment, the invention provides a down-hole drilling tool comprising: a housing; a bit connected to an end of the housing and adapted to drill rock; a piston comprising a central piston bore and at least one conduit communicating with the central piston bore; a control tube including at least one port, the control tube receiving a flow of motive fluid comprising an actuator supply portion and a bit flow portion; a drive chamber above the piston; and a return chamber between the piston and the bit; wherein the control tube extends through the central piston bore and the piston reciprocates along the control tube; wherein reciprocation of the piston along the control tube periodically places the at least one conduit in the piston in communication with the at least one port in the control tube; wherein periodic communication between the at least one conduit and at least one port causes the actuator supply portion of the motive fluid in the control tube to be supplied to the drive chamber and return chamber in alternating fashion, to cause the piston to respectively move into impact with the bit and lift away from the bit; wherein the actuator supply portion of the motive fluid becomes actuator exhaust upon flowing out of the drive chamber and return chamber, the actuator exhaust flowing along an actuator exhaust path and being vented above the bit; wherein the bit flow portion of the motive fluid in the control tube flows along a bit exhaust path and is vented through the bit; and wherein the bit exhaust path is separate from and schematically parallel to at least a portion of the actuator exhaust path.

In one embodiment of the invention, reciprocating movement of the piston at least temporarily cuts off communication between the drive chamber and the actuator exhaust path while placing return chamber in communication with the actuator exhaust path, and at least temporarily cuts off communication between the return chamber and the actuator exhaust path while placing the drive chamber in communication with the actuator exhaust path. In another embodiment, the invention further comprises a drive exhaust port communicating between the drive chamber and the actuator exhaust path; and a return exhaust port communicating between the return chamber and the actuator exhaust path; wherein reciprocating movement of the piston at least temporarily cuts off communication between the drive chamber and the actuator exhaust path by covering the drive exhaust port with a portion of the piston; and wherein reciprocating movement of the piston at least temporarily cuts off communication between the return chamber and the actuator exhaust path by covering the return exhaust port with a portion of the piston. In another embodiment, the at least one port in the control tube includes a drive supply port and a return supply port; wherein the piston includes a drive supply conduit and a return supply conduit; wherein reciprocating movement of the piston at least temporarily places the drive chamber in communication with the actuator flow path by aligning the drive supply port with the drive supply conduit; and wherein reciprocating movement of the piston at least temporarily places the return chamber in communication with the actuator flow path by aligning the return supply port with the return supply conduit. In another embodiment, the invention further comprises a flow plate at least partially defining a throttle chamber; and check valve within the throttle chamber; wherein adjustment of the check valve at least partially controls the ratio of the bit flow portion to the actuator supply portion of the motive fluid.

In another embodiment, the invention further comprises a top sub defining a top end of the drilling tool and adapted for connection to a drill pipe; wherein the actuator exhaust path vents the actuator exhaust through the top sub; and wherein the flow plate is adapted to be clamped to the drilling tool by attachment of the drill pipe to the housing.

Other aspects of the invention will become apparent by consideration of the detailed description and accompanying drawings.

DETAILED DESCRIPTION

Figure 1:
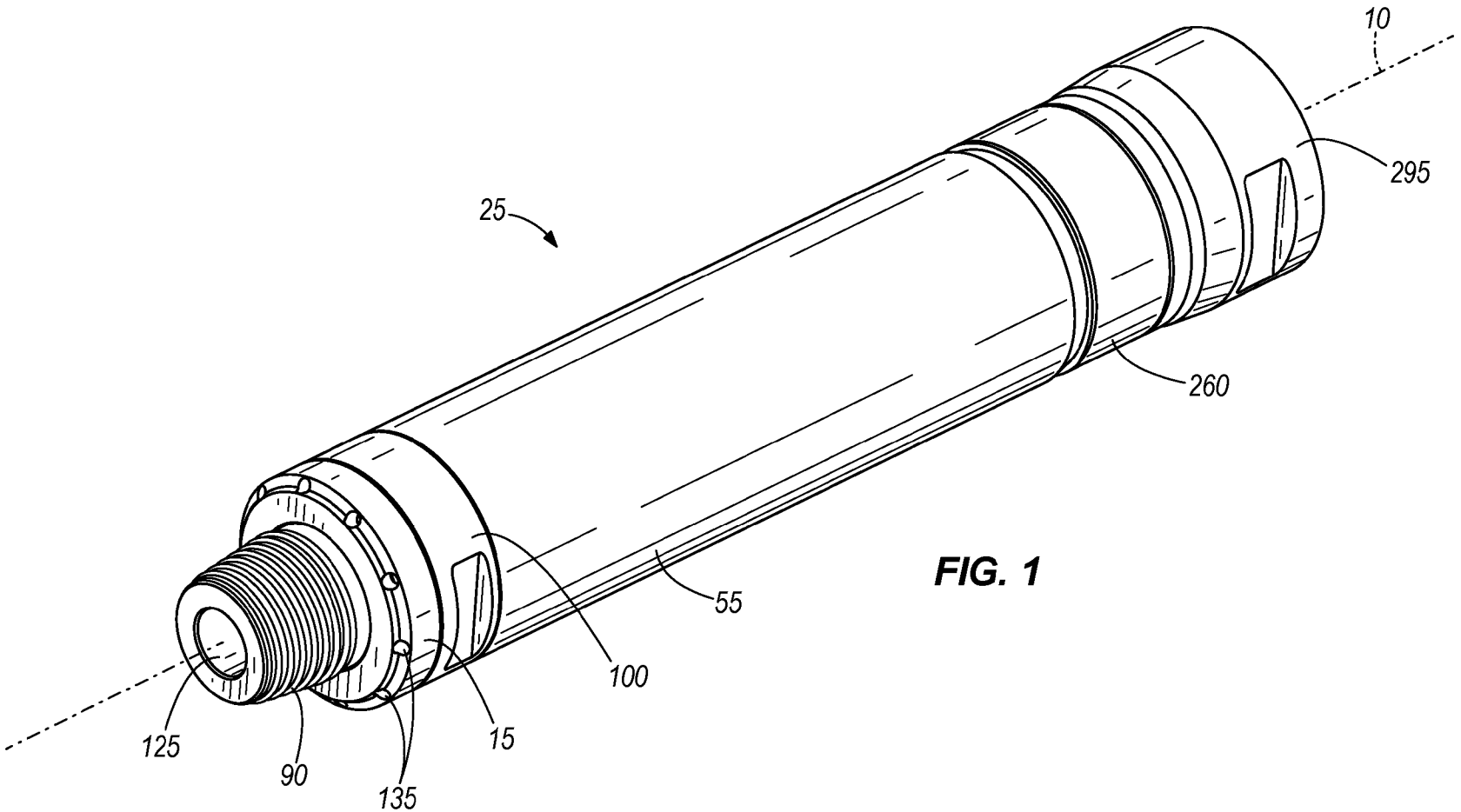
FIG. 1 is a perspective view of a percussive assisted rotary drill assembly embodying the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

For the sake of simplicity and consistency in this specification, the term "axial" means in a direction parallel to a central axis 10 of a percussive assisted rotary drill assembly 25 illustrated in the drawings. All of the main elements of the drill assembly 25 discussed below are generally ring-shaped or cylindrical and therefore all have inner and outer surfaces. The term "inner surface" means the surface facing toward the central axis 10 or generally toward the inside of the drill assembly 25 and the term "outer surface" means the surface facing away from the central axis 10 or generally away from the inside of the drill assembly 25. All elements also have first and second ends which, using the convention of the illustrated embodiment, will be referred to as "top" and "bottom" ends with respect to the typical operating orientation of the rotary drill assembly 25, which orientation is illustrated in FIGS. 2-6. Also, terms such as "above" and "elevated" describe a relative position while the drill assembly 25 is in the typical operating orientation.

While the invention is illustrated in the drawings and described below in the embodiment of a PARD (i.e., having both rotary and impact aspects to the drilling operation), such embodiment is not limiting to the scope of the invention. The invention may also be embodied in a pure DTH drill arrangement in which there is no rotary component. The invention may be embodied in drilling arrangements using substantially any type of drill bit, including a standard bit, drag bit, rotary bit, or another cutting surface suitable for or adaptable to impact loading. The invention may also be embodied in substantially any other down hole hammer application in which at least a portion of the motive fluid is exhausted somewhere other than through the drill bit.

Figure 2:
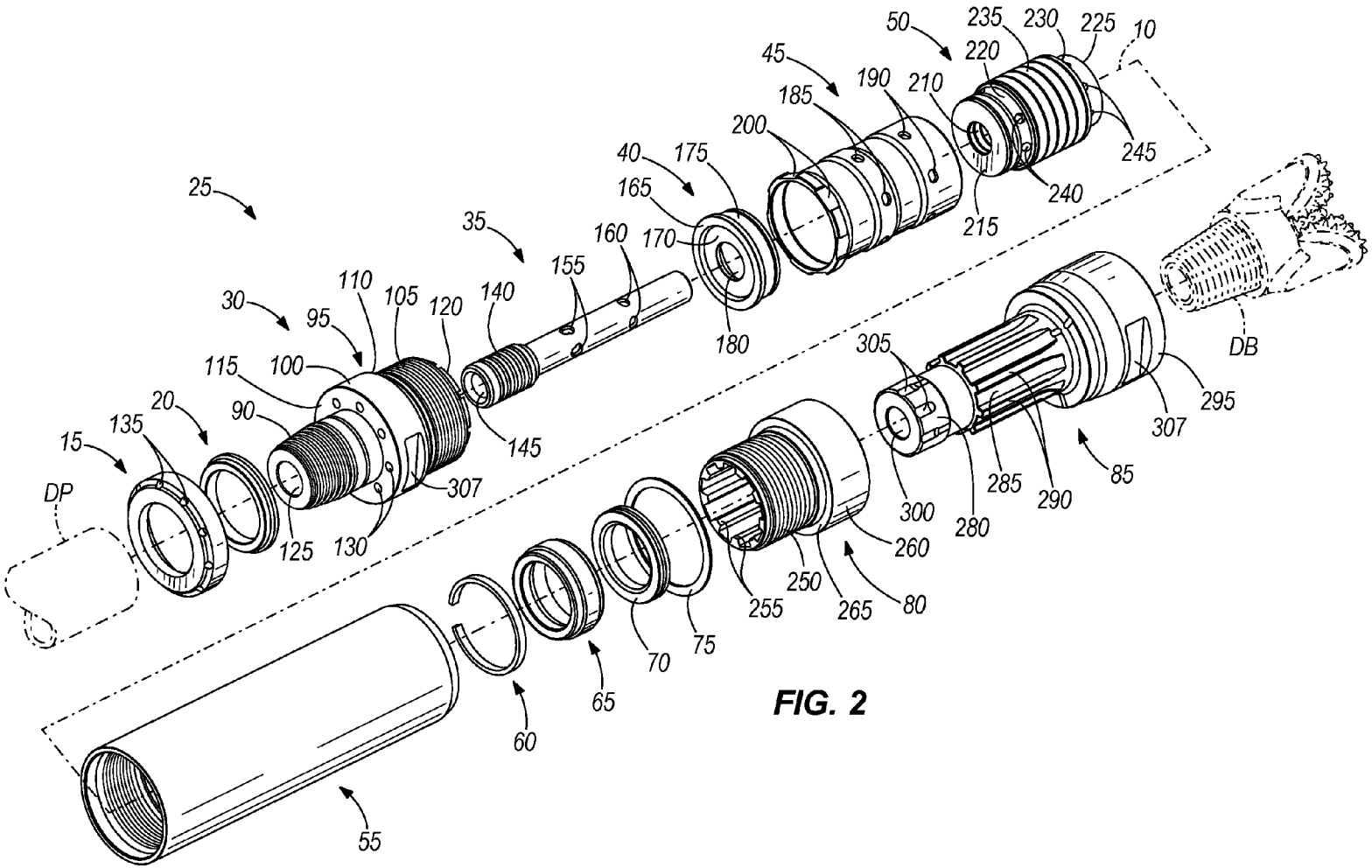
FIG. 2 is an exploded view of the drill assembly.

FIGS. 1 and 2 illustrate a flow plate 15, a check valve 20, and a percussive assisted rotary drill assembly 25. The drill assembly 25 includes the following basic components: a rotary tool joint or top sub 30, a control tube 35, a cylinder head 40, a cylinder 45, a piston or actuator 50, an outer sleeve 55, a snap ring 60, a bit bearing 65, a bit retainer or split ring 70, a washer 75, a chuck 80, and a shank adapter 85. A hammer assembly of the tool 25 includes the illustrated reciprocating piston 50 or other actuator and other components that control the flow of motive fluid to actuate the piston 50 or other actuator.

The top sub 30 includes an American Petroleum Institute ("API") male threaded connector 90 that is adapted to be threadedly received within a drill pipe DP. The top sub 30 also includes a main body 95 that includes a large diameter cylindrical portion 100 and a small diameter cylindrical portion 105. A step or shoulder 110 is defined between the large and small diameter cylindrical portions 100, 105. The top of the large diameter cylindrical portion 100 defines an exhaust face 115 around the API connector 90. The bottom end 120 of the small diameter cylindrical portion 105 has a reduced diameter. A top sub bore 125 extends axially through the center of the top sub 30. The main body 95 includes multiple exhaust bores 130 arranged around and generally parallel to the top sub bore 125.

The flow plate 15 and check valve 20 are ring-shaped and surround the API connector 90 of the top sub 30. In the illustrated embodiment, the flow plate 15 is pressed or clamped against the exhaust face 115 by the drill pipe DP when the drill pipe DP is threaded onto the API connector 90. In other embodiments, the flow plate may be part of or integral with the back head. The flow plate 15 includes exhaust holes 135 that communicate with the space around the drill assembly 25 and drill pipe DP. The check valve 20 is free to move axially within the space defined between the flow plate 15 and the top sub 30 (the throttle chamber, as will be discussed below). As will be discussed in more detail below, the flow plate 15, check valve 20, or the combination of the flow pate 15 and check valve 20 operates as a throttle for operation of the piston 50.

The control tube 35 includes an enlarged mounting end 140 received within the top sub bore 125. The control tube 35 defines an axially-extending control bore 145. A plurality of o-ring seals 150 (FIG. 3) provides a substantially air-tight seal between the top sub bore 125 and the outer surface of the enlarged mounting end 140 of the control tube 35. Consequently, fluid flowing through the top sub bore 125 is substantially prevented from flowing around the outer surface of the enlarged mounting end 140, and is instead forced to flow into the control bore 145. The control tube 35 also includes drive supply ports 155 and return supply ports 160 communicating through the sides of the control tube 35.

The cylinder head 40 includes a ring-shaped flange 165, a ring-shaped support surface 170 that is surrounded by and recessed with respect to the flange 165, and a depending skirt 175. The support surface 170 defines a central hole 180 through which the control tube 35 extends. The enlarged mounting end 140 of the control tube 35 and one of the sealing o-rings 150 abut against the support surface 170 to create a substantially air-tight seal between the control tube 35 and the support surface 170. Consequently, there is substantially no fluid flow through the central hole 180 of the cylinder head 40 except through the control bore 145 of the control tube 35. The bottom end 120 of the small diameter cylindrical section 105 abuts the support surface 170 of the cylinder head 40, which positions the bottom ends of the exhaust bores 130 adjacent the flange 165. Exhaust fluids flowing around the cylinder head 40 can flow into the exhaust bores 130 of the top sub 30.

The cylinder 45 includes drive exhaust ports 185 and return exhaust ports 190 that communicating through a side of the cylinder 45. The bottom of the cylinder head 40 flange 165 abuts a top end of the cylinder 45, and the depending skirt 175 of the cylinder head 40 extends into the cylinder 45. A sealing member 195 (FIG. 3) provides a substantially air-tight seal between the depending skirt 175 of the cylinder head 40 and the inner surface of the cylinder 45. The top end of the cylinder 45 includes grooves 200 that permit exhaust fluid flowing around the outside of the cylinder 45 to flow past the top end of the cylinder 45.

The piston 50 includes a central piston bore 210, a drive end 215 having a beveled ring-shaped surface 220, a return end 225 also having a beveled ring-shaped surface 230, and an enlarged-diameter middle portion 235. The piston bore 210 is closely dimensioned to receive the control tube 35 such that the piston 50 is free to slide along the control tube 35 while maintaining close tolerances and a substantially air-tight seal between the piston bore 210 and the outer surface of the control tube 35. A plurality of drive conduits 240 communicate between the piston bore 210 and the beveled surface 220 on the drive end 215 of the piston 50, and a plurality of return conduits 245 communicate between the piston bore 210 and the beveled surface 230 on the return end 225 of the piston 50. As will be discussed in more detail below, as the piston 50 reciprocates along the control tube 35, the drive conduits 240 are placed in communication with the drive supply ports 155 of the control tube 35, or the return conduits 245 are placed in communication with the return supply ports 160 of the control tube 35. The piston 50 is received within the cylinder 45, and the enlarged-diameter middle portion 235 of the piston 50 is closely dimensioned to slide against the inner surface of the cylinder 45.

An internal surface of the outer sleeve 55 includes threads at each of the top and bottom ends. The internal surface also includes internal shoulders and other surfaces (visible in FIGS. 3-6) against which bear the top sub 30, cylinder 45, snap ring 60, and chuck 80. The external threads on the main body 95 of the top sub 30 thread into the threads in the top end of the outer sleeve 55. The snap ring 60 is positioned against a portion of the inner surface of the outer sleeve 55, and the bit bearing 65 and split ring 70 are stacked against the snap ring 60 within the outer sleeve 55.

The chuck 80 includes an internally-splined portion 250 which has internal splines 255 and external threads, and an enlarged head portion 260 which defines a ring-shaped bearing surface 265 at the base of the internally-splined portion 250. The washer 75 sits on the ring-shaped bearing surface 265 around the internally-splined portion 250. The internally-splined portion 250 is threaded into the bottom end of the outer sleeve 55 until the bottom end of the outer sleeve 55 bears against the washer 75 and ring-shaped bearing surface 265. The internally-splined portion 250 of the chuck 80 forces the split ring 70 and bit bearing 65 against the snap ring 60 as the chuck 80 is threaded into the outer sleeve 55.

The shank adapter 85 includes an anvil 280 at its top end, an externally-splined portion 285 having external splines 290, and a bit-mounting head 295 at its bottom end. An adapter bore 300 extends axially from the top end to the bottom end of the shank adapter 85. The anvil 280 is received within the bit bearing 65, with the control tube 35 extending into the adapter bore 300. The anvil 280 includes external blow down grooves 305 that permit the blow down of exhaust fluid through the bit bearing 65, split ring 70, and chuck 80 to enable more quick stopping of the hammer assembly cycle.

The bit-retaining head 295 includes internal threads or other suitable connecting apparatus for receiving a rotary drill bit (e.g., a tricone) DB or other suitable work piece for rock drilling. In other embodiments, the entire shank adapter 85 may be integrally formed with the drill bit DB, instead of being provided as separate parts as illustrated. The drill bit DB includes an exterior surface or working surface that bears against rock or other material being drilled.

The external splines 290 of the splined portion 285 mesh with the internal splines 255 of the chuck 80 such that torque is transmitted from the chuck 80 to the shank adapter 85, while the shank adapter 85 is permitted to move axially within the chuck 80. Top edges of the external splines 290 and a bottom surface of the anvil 280 define stopping surfaces for axial movement of the shank adapter 85 with respect to the chuck 80. The split ring 70 is assembled around the shank adapter 85 between the stopping surfaces.

The drill assembly 25 is assembled by extending the control tube 35 through the central hole 180 of the cylinder head 40, placing the cylinder head 40 on the top end of the cylinder 45, and positioning the piston 50 inside the cylinder 45 with the control tube 35 extending through the piston bore 210. The top sub 30 is then positioned with the enlarged mounting end 140 of the control tube 35 inside the top sub bore 125 and is threaded into the top end of the outer sleeve 55 such that the bottom end 120 of the top sub 30 abuts against the support surface 170 of the cylinder head 40. A gap exists between the shoulder 110 and the top of the outer sleeve 55, which may be referred to as "stand off." Then the snap ring 60 and bit bearing 65 are positioned within the outer sleeve and the subassembly of the split ring 70, shank adapter 85, chuck 80, and washer 75 is inserted into the lower end of the outer sleeve 55. The internally-splined section 250 of the chuck 80 is threaded into the bottom end of the outer sleeve 55. Wrenches are then applied to flats 307 on the top sub 30 and shank adapter 85, and torque is applied to both to cause the top sub 30 to further thread into the top end of the outer sleeve 55 such that the bottom end 120 pushes the cylinder head 40 into the top of the cylinder 45 and creates a clamping load to keep the cylinder head 40 and cylinder 45 locked together during heavy vibrations arising from use of the drill assembly 25.

Figure 3:
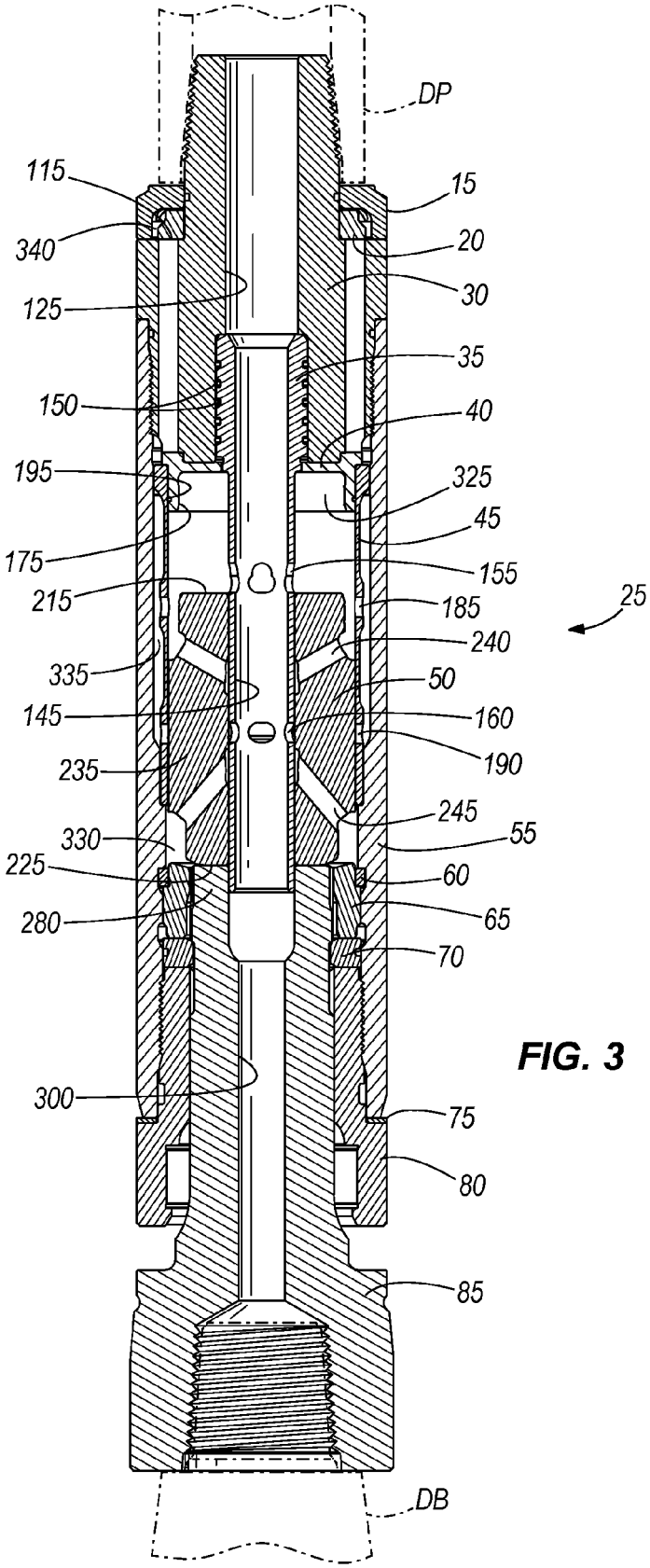
FIG. 3 is a cross-sectional view of the drill assembly in a bottomed-out standby condition.
Figure 4:
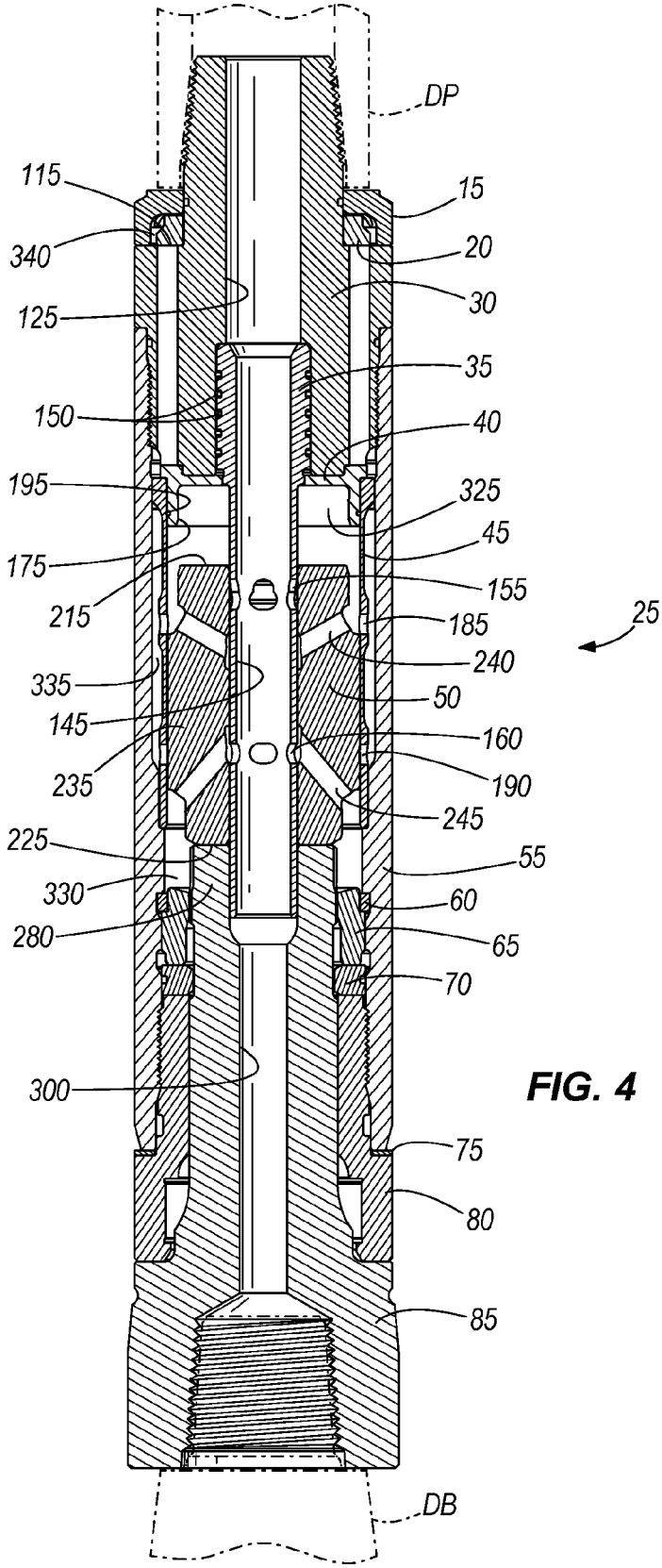
FIG. 4 is a cross-sectional view of the drill assembly at the end of the drive stroke and beginning of the return stroke.
Figure 5:
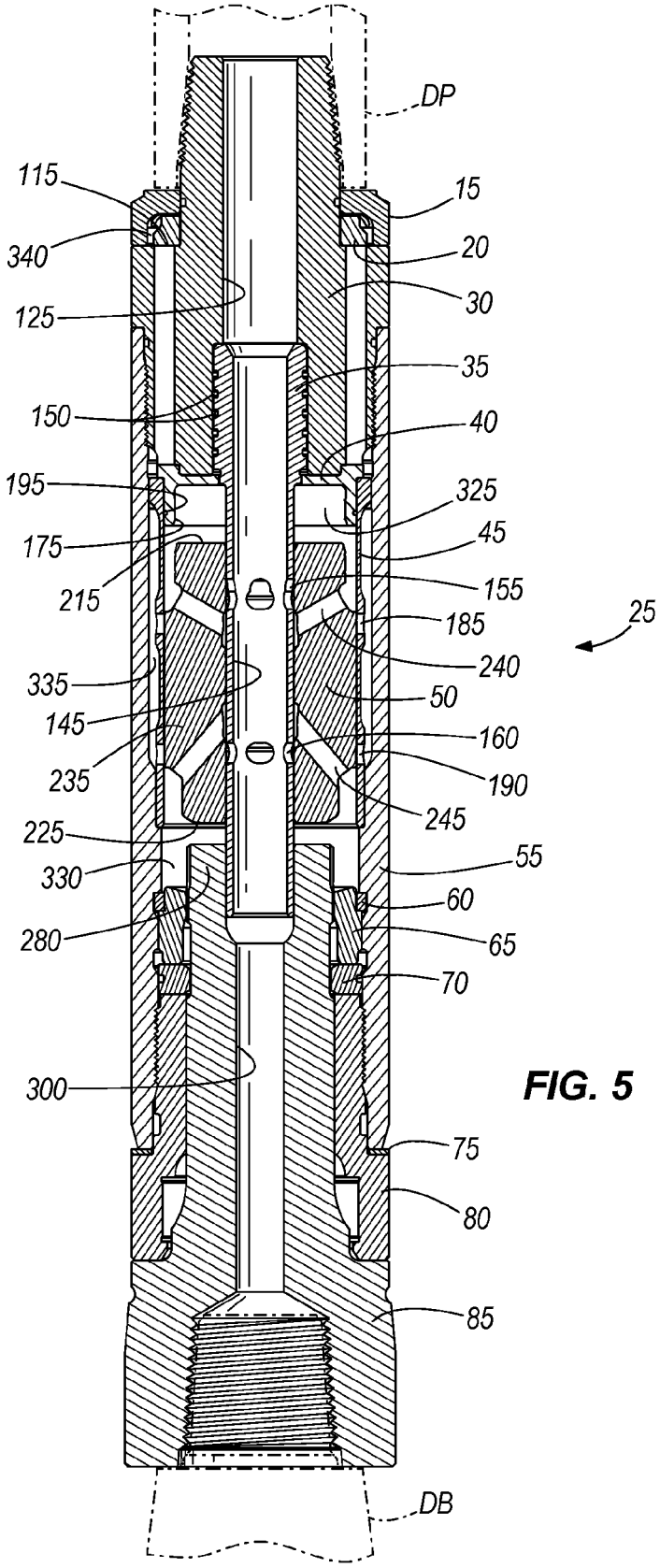
FIG. 5 is a cross-sectional view of the drill assembly in the middle of the drive stroke and return stroke.
Figure 6:
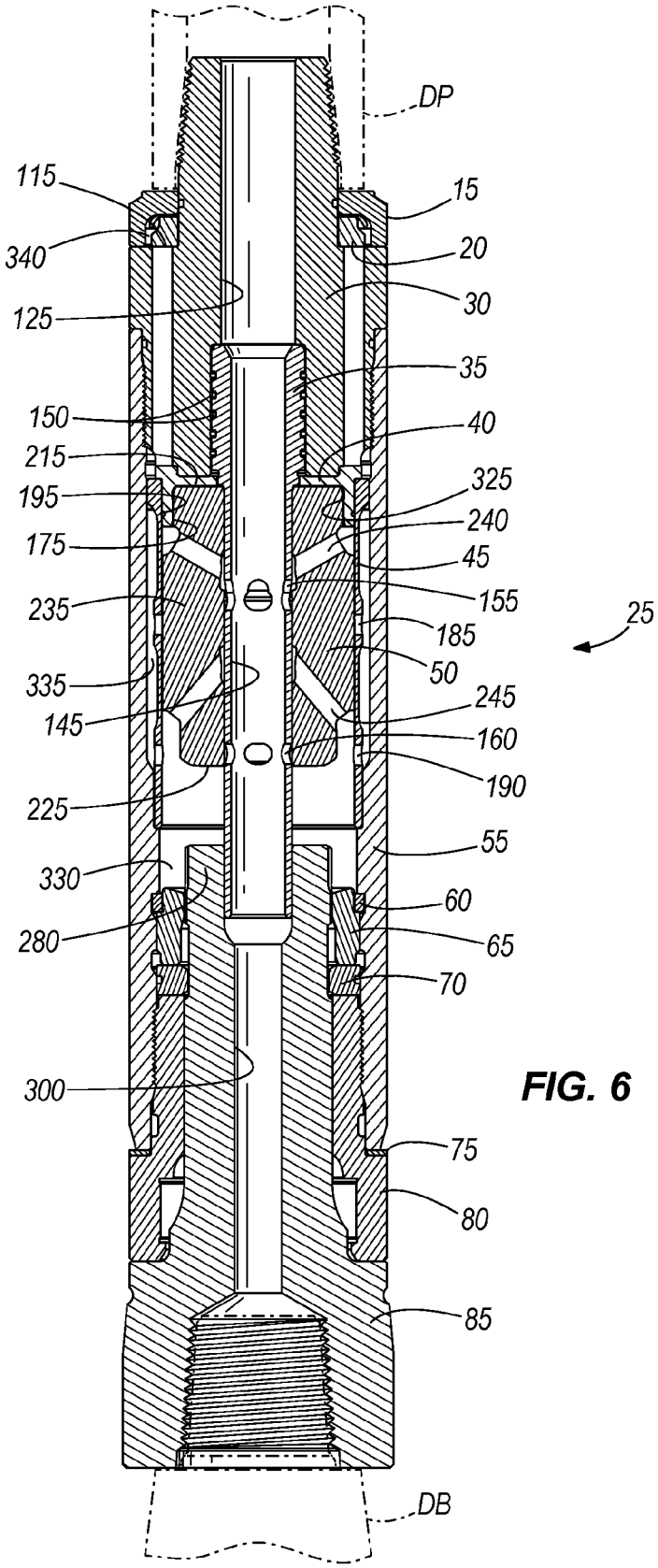
FIG. 6 is a cross-sectional view of the drill assembly at the beginning of the drive stroke and end of the return stroke.

With reference to FIG. 3, when the drill assembly 25 is not being pushed against rock and is simply subject to forces arising from gravity, the shank adapter 85 bottoms out with the bottom surface of the anvil 280 resting on top of the split ring 70. With reference to FIGS. 4-6, when the drill assembly 25 is engaged against rock, the shank adapter 85 is pushed up until it tops out when the tops of the external splines 290 abut the bottom of the split ring 70 and the bit-mounting head 295 bears against the enlarged head 260 of the chuck 80.

As assembled, the drill assembly 25 defines a central bore consisting of the top sub bore 125, the control bore 145, and the adapter bore 300. The drill assembly 25 also defines several passages and chambers. A drive chamber 325 is defined between the cylinder head 40, the inner surface of the cylinder 45, the outer surface of the control tube 35, and the drive end 215 of the piston 50. A return chamber 330 is defined between the return end 225 of the piston 50, the inner surface of the cylinder 45, the inner surface of the outer sleeve 55, the top of the bit bearing 65, the anvil 280, and the outer surface of the control tube 35. An annular exhaust chamber 335 is defined between the outer surface of the cylinder 45 and the inner surface of the outer sleeve 55. A throttle chamber 340 is defined between the flow plate 15 and the exhaust face 115 of the top sub 30. The check valve 20 is within the throttle chamber 340.

The drill assembly 25 also defines a bit exhaust path, an actuator flow path, and an actuator exhaust path. The actuator flow path and actuator exhaust path are in series in the illustrated embodiment, and the bit exhaust path is schematically parallel to the actuator flow path and actuator exhaust path. As used with respect to flow and exhaust paths, the term "series" means that fluid flows from one path into the other, and the term "schematically parallel" means that the paths are not in series. The bit exhaust path includes the central bore downstream of the drive and return supply ports 155, 160, and delivers motive fluid (e.g., compressed air) to the drill bit DB where it flows out of the drill bit DB, over the drill bit's exterior surface, and up through the bore between the drill assembly and bore wall as bit exhaust. In other embodiments, such as reverse circulation systems, the bit exhaust may flow out of the tool above the drill bit DB, flow over the exterior surface of the drill bit, and return to the surface through the bit bore and other conduits in the drill pipe DP. The terms "bit exhaust" and "through the drill bit" and similar terms are intended to cover exhaust that flows over the exterior surface of the drill bit, whether in a regular or reverse circulation direction.

The actuator flow path includes the drive supply ports 155, drive conduits 240, drive chamber 325, drive exhaust ports 185 (these four components, collectively, the "drive side" of the actuator flow path), return supply ports 160, return conduits 245, return chamber 330, and return exhaust ports 190 (these last four components, collectively, the "return side" of the actuator flow path). The actuator exhaust path includes the annular exhaust chamber 335, the grooves 200 at the top of the cylinder 45, and the exhaust bores 130. Motive fluid flowing out of the actuator flow path through the drive side and return side becomes actuator exhaust which flows into the actuator exhaust path. The actuator exhaust path delivers the actuator exhaust to the throttle chamber 340.

In the throttle chamber 340, the actuator exhaust is restricted as it lifts and flows around the check valve 20. Finally, the actuator exhaust flows out of the throttle chamber 340 through the exhaust holes 135 in the flow plate 15. The flow of actuator exhaust out of the exhaust holes 135 in the flow plate 15 assists the upward flow of cuttings and debris being evacuated from the hole or bore being drilled. The check valve 20 blocks cuttings and other debris from falling into the exhaust path.

In other embodiments, the actuator exhaust path may include schematically parallel exhaust paths for the drive chamber 325 and return chamber 330 which may vent actuator exhaust at different elevated axial locations with respect to the drill bit DB. Alternatively, one of the schematically parallel exhaust paths could be in series with the bit exhaust path such that some of the actuator exhaust flows over the exterior surface of the drill bit DB. The illustrated actuator exhaust path may be advantageous over an exhaust path that exhausts one or both of the drive and return chambers 325, 330 over the exterior surface of the drill bit DB because it reduces the volume of fluid flow over the exterior surface of the drill bit DB. Reducing the volumetric flow over the drill bit DB and other external members may reduce wear rates of such components and increase component life.

It will be appreciated that, although the illustrated embodiment includes an actuator exhaust path that vents the actuator exhaust through the top of the drill assembly 25, the invention is applicable to any embodiment that includes elevated exhaust, by which is meant exhaust holes above the drill bit DB or elsewhere to substantially avoid flowing any of the actuator exhaust over the exterior surface of the drill bit DB. For example, exhaust holes may be provided through the outer sleeve 55.

In operation, a conventional rotational force drives rotation of the drill pipe DP. Torque from the drill pipe DP is transmitted to the drill bit DB through a torque path that includes the top sub 30, outer sleeve 55, chuck 80, and shank adapter 85. In the illustrated embodiment, all elements of the torque path are coupled by way of threaded interconnections, except between the chuck 80 and shank adapter 85 which is by way of the splines 255, 290. In other embodiments, the elements in the torque path may be coupled in other ways than threaded and splined connections, so long as the essential purpose of torque transfer is met.

During standby (FIG. 3) when the drill assembly 25 is not engaged against the bottom of a hole or bore being drilled, the shank adapter 85 is bottomed out under the influence of gravity and the piston 50 rests on the anvil 280. In this condition, sometimes referred to as blow down, the drive supply ports 155 of the control tube 35 are not aligned with the drive conduits 240 of the piston 50 (they are, in fact, above the piston), and the return supply ports 160 of the control tube 35 are not aligned with the return conduits 245 of the piston 50 (they are blocked by the middle portion 235). Motive fluid is typically supplied through the drill pipe DP during standby. Such motive fluid flows through the bit exhaust path and the drive side of the actuator flow path (except that the motive fluid flows directly from the drive supply ports 155 into the drive chamber 325 without flowing through the drive conduits 240) and is exhausted as bit exhaust and actuator exhaust. The bit exhaust and actuator exhaust resist debris from entering the drill assembly 25 during standby, and provide sufficient flow paths to avoid significant pressure increase in the drill assembly 25.

When the drill bit DB is lowered to the bottom of the hole and engages rock or other substance to be drilled, the shank adapter 85 is pushed up toward the position illustrated in FIG. 4. As the shank adapter 85 moves up, it pushes the piston 50 up as well. The return conduits 245 register with the return supply ports 160 as the shank adapter 85 approaches its topped out position. Once the return conduits 245 are placed in communication with the return supply ports 160, the actuator flow is directed to the return side. The actuator flow alternates between the drive side and return side to cause the piston 50 to reciprocate and impact the anvil 280. In other embodiments, the drive and supply sides may drive non-reciprocal piston operation. The bit exhaust continues to flush cuttings and other debris around the outside of the bit DB. The bit exhaust and actuator exhaust together push such debris up to the surface through the hole being drilled.

The cycle of piston 50 reciprocation is described below, with upward movement of the piston 50 referred to as the "return stroke" and downward movement referred to as the "drive stroke." With reference to FIGS. 4-6, the motive fluid supply and fluid exhaust logic is controlled and timed by the relative positions of the drive supply ports 155 and return supply ports 160, the drive conduits 240 and return conduits 245, and the drive exhaust ports 185 and return exhaust ports 190.

With reference to FIG. 4, during the terminal portion of the drive stroke and the initial portion of the return stroke, the middle portion 235 of the piston 50 covers the return exhaust port 190 and the return conduits 245 register with the return supply ports 160 while at the same time the drive exhaust ports 185 are uncovered by the middle portion 235 of the piston 50 (i.e., the drive exhaust ports 185 communicate with the drive chamber 325) and the drive conduits 240 are not registered with the drive supply ports 155. Thus, during the terminal portion of the drive stroke, there is slight compression of fluid in the return chamber 330 but such compression is negligible and does not materially affect the momentum of the piston 50 and its impact on the anvil 280, and such compression is dissipated by blow down through the grooves 305. During the initial portion of the return stroke, there is a rapid build-up of pressure in the return chamber 330 due to motive fluid rushing in through the return conduits 245. Additionally, initial upward movement of the piston 50 is not restricted by significant opposing pressure in the drive chamber 325 because fluid in the drive chamber 325 is exhausted through the drive exhaust ports 185 into the exhaust path described above.

With reference to FIG. 5, during the middle segment of the drive and return strokes, the middle portion 235 of the piston 50 covers the drive exhaust ports 185 and return exhaust ports 190, and neither of the drive conduits 240 nor the return conduits 245 are registered with the respective drive supply ports 155 or return supply ports 160. From this point until the end of the drive and return strokes, the piston 50 moves partially under the influence of pressure built up in the respective drive and return chambers 325, 330 during the initial portion of the stroke and partially under the influence of momentum. As volume in the drive and return chambers 325, 330 increases due to movement of the piston 50 in the respective drive and return strokes, the pressure-assist component of movement is reduced, and the piston 50 moves primarily under the influence of the momentum it gained during the initial portion of the stroke.

With reference to FIG. 6, during the terminal portion of the return stroke and the initial portion of the drive stroke, the middle portion 235 of the piston 50 covers the drive exhaust port 185 and the drive conduits 240 register with the drive supply ports 155 while at the same time the return exhaust ports 190 are uncovered by the middle portion 235 of the piston 50 (i.e., the return exhaust ports 190 communicate with the return chamber 330) and the return conduits 245 are not registered with the return supply ports 160. Thus, during the terminal portion of the return stroke, there is slight compression of fluid in the drive chamber 325 to assist in arresting upward movement of the piston 50. During the initial portion of the drive stroke, there is a rapid build-up of pressure in the drive chamber 325 due to motive fluid rushing in through the drive conduits 240. Additionally, initial downward movement of the piston 50 is not restricted by significant opposing pressure in the return chamber 330 because fluid in the return chamber 330 is exhausted through the return exhaust ports 190 into the exhaust path described above.

The illustrated drill assembly 25 therefore has a rotary component (the drill bit DB rotates under the influence of the torque transmitted through the drill pipe DP and the drill assembly 25) and a percussive component arising from the piston 50 impacting the anvil 280. The impact of the piston 50 on the anvil 280 is transmitted through the shank adapter 85 and bit DB to the rock or other substance being drilled by the drill assembly 25, which assists in the drilling operation. The axially-directed impact on the anvil 280 is not borne by any other component of the drill assembly 25; the distance between the bottom of the anvil 280 and the top of the external splines 290 is selected to accommodate the largest expected deflection of the shank adapter 85 to prevent the shank adapter 85 from bottoming out. After impacting the anvil 280, the piston 50 typically rebounds slightly, but the degree of rebound depends at least in part on the hardness of the substance being drilled. The return conduits 245 and return supply ports 160 are sized to register with each other in the instance of no rebound or a degree of rebound within an expected range. Once the return supply ports 160 and return conduits 245 register with each other, the cycle begins again.

Fundamentally, the volume and flow rates of the bit and actuator flows are defined by the relative resistance in the actuator and bit exhaust paths. The level of resistance to the actuator exhaust flow is affected by the size and shape of the exhaust holes 135 in the flow plate 15 or the size and shape of the check valve 20 or the interaction between the flow plate 15 and check valve 20, or a combination of two or more of the these factors. A more restrictive actuator exhaust path (arising from, for example, a lower lift check valve 20 and/or more restrictive exhaust holes 135) will result in lower actuator power, while a less restrictive actuator exhaust path (arising from, for example, a higher lift check valve 20 and/or less restrictive exhaust holes) will result in higher actuator power.

As resistance to the actuator exhaust flow increases, so does the backpressure in the actuator exhaust path, which ultimately affects the rate at which actuator exhaust fluid is pushed out of or displaced from the drive chamber 325 and return chamber 330 through the drive exhaust ports 185 and return exhaust ports 190 during piston 50 reciprocation. Speed and frequency of piston 50 reciprocation is affected, at least in part, by the rate at which exhaust fluid is displaced out of the drive chamber 325 and return chamber 330 through the drive exhaust ports 185 and return exhaust ports 190. The faster motive fluid can be exhausted from the drive and return chambers 325, 330, the faster the piston 50 can reciprocate and the more impact power ("actuator power") the piston 50 can deliver to the drill bit DB.

An operator of the drill assembly 25 may adjust the split between bit and actuator flow by changing the size or shape of the check valve 20, the space within the throttle chamber 340 accommodating axial movement of the check valve 20, the size or shape of the exhaust holes 135 in the flow plate 15, or a combination of these factors. Because the flow plate 15 and check valve 20 are secured to the drill assembly 25 only by the drill pipe DP connection trapping and clamping the flow plate 15 against the top sub 30, the flow plate 15 and/or check valve 20 can be removed and replaced by merely disconnecting the drill pipe DP, replacing the parts, and re-connecting the drill pipe DP. Other than disconnecting and reconnecting the drill pipe DP, there are no fasteners or other connections that must be removed or loosened in the process of changing the check valve 20 in the illustrated embodiment.

Additionally, replacement of the flow plate 15 and/or check valve 20 does not require disconnection of the outer sleeve 55 from the top sub 30 or chuck 80 or any other disassembly of the drill assembly 25, because the flow plate 15 and check valve 20 are external parts. Also, changing the flow plate 15 and/or check valve 20 permits the actuator power output to be adjusted while maintaining supply pressure constant. Thus, the flow plate 15 and check valve 20 subassembly permits one to adjust actuator power independent of supply pressure by simply changing an external part and without requiring a change in bit nozzle, and the flow plate 15 and check valve 20 may be said to function as a throttle for the bit and actuator flows.

Operating the bit exhaust path schematically parallel with the actuator flow path and actuator exhaust path is advantageous compared to operating the paths in series. The piston 50 operates at full system pressure and thus develops more actuator power when driven by actuator flow that is schematically parallel with respect to bit flow, than when compared to actuator flow that is in series with the bit flow. The schematically parallel bit and actuator flows achieve the dual benefit of clearing cuttings and other debris with minimal bit wear via bit flow, and boosting the hole cleaning flow above the drill assembly 25 via elevated actuator exhaust to assist in removal of cuttings and other debris from the hole. The illustrated embodiment of the present invention therefore exhausts the entire actuator exhaust out of an elevated exhaust (out of the top of the drill assembly 25 in the illustrated embodiment) and the entire bit exhaust out of the bottom of the drill assembly 25 through the drill bit DB. In other embodiments, it is possible to exhaust only one of the drive side and return side (i.e., less than the entire actuator flow) through an elevated exhaust and the other side out the drill bit DB.

In a series arrangement in which actuator exhaust is recycled as bit flow, backpressure in the bit flow path can affect the flow rate of actuator exhaust which may unnecessarily reduce actuator power. A schematically parallel arrangement of the bit and actuator flows decouples backpressure in the bit exhaust path from the actuator flow path.

One advantage of the present invention is to provide higher frequency impact loads to the drill bit DB when compared to known DTH and PARD rigs at an equal pressure and similar outer dimension size of the tool. For example, and without limitation, while a standard eight inch DTH hammer may operate at a frequency of about 16 Hz at 100 psi, a similar sized down hole hammer according to the present invention operating at the same pressure may operate at about 25 Hz. The present invention will operate at a wide range of motive fluid pressures, with a typical range of operating pressures around 50-100 psi, but may also operate under higher pressure (e.g., about 150 psi) in rotary drilling environments or even much higher pressures if used in oil gas drilling environments.

Thus, the invention provides, among other things, a down hole hammer that exhausts at least a portion of the motive fluid through a portion of the drill other than the drill bit. The invention also provides a down hole hammer having schematically parallel bit and actuator flow paths. Various features and advantages of the invention are set forth in the following claims.

What is claimed is:

1. A down-hole drilling tool comprising:

a housing;

a bit connected to an end of the housing and adapted to drill rock;

a piston comprising a central piston bore and at least one conduit communicating with the central piston bore;

a control tube including at least one port, the control tube receiving a flow of motive fluid comprising an actuator supply portion and a bit flow portion;

a drive chamber above the piston; and a return chamber between the piston and the bit;

wherein the control tube extends through the central piston bore and the piston reciprocates along the control tube;

wherein reciprocation of the piston along the control tube periodically places the at least one conduit in the piston in communication with the at least one port in the control tube;

wherein periodic communication between the at least one conduit and at least one port causes the actuator supply portion of the motive fluid in the control tube to be supplied to the drive chamber and return chamber in alternating fashion, to cause the piston to respectively move into impact with the bit and lift away from the bit;

wherein the actuator supply portion of the motive fluid becomes actuator exhaust upon flowing out of the drive chamber and return chamber, the actuator exhaust flowing along an actuator exhaust path and being vented above the bit;

wherein the bit flow portion of the motive fluid in the control tube flows along a bit exhaust path and is vented through the bit; and wherein the bit exhaust path is separate from and schematically parallel to at least a portion of the actuator exhaust path.

2. The down-hole drilling tool of claim 1, wherein reciprocating movement of the piston at least temporarily cuts off communication between the drive chamber and the actuator exhaust path while placing return chamber in communication with the actuator exhaust path, and at least temporarily cuts off communication between the return chamber and the actuator exhaust path while placing the drive chamber in communication with the actuator exhaust path.

3. The down-hole drilling tool of claim 1, further comprising a drive exhaust port communicating between the drive chamber and the actuator exhaust path; and a return exhaust port communicating between the return chamber and the actuator exhaust path; wherein reciprocating movement of the piston at least temporarily cuts off communication between the drive chamber and the actuator exhaust path by covering the drive exhaust port with a portion of the piston; and wherein reciprocating movement of the piston at least temporarily cuts off communication between the return chamber and the actuator exhaust path by covering the return exhaust port with a portion of the piston.

4. The down-hole drilling tool of claim 1, wherein the at least one port in the control tube includes a drive supply port and a return supply port; wherein the piston includes a drive supply conduit and a return supply conduit; wherein reciprocating movement of the piston at least temporarily places the drive chamber in communication with the actuator flow path by aligning the drive supply port with the drive supply conduit; and wherein reciprocating movement of the piston at least temporarily places the return chamber in communication with the actuator flow path by aligning the return supply port with the return supply conduit.

5. The down-hole drilling tool of claim 1, further comprising a flow plate at least partially defining a throttle chamber; and check valve within the throttle chamber; wherein adjustment of the check valve at least partially controls the ratio of the bit flow portion to the actuator supply portion of the motive fluid.

6. The down-hole drilling tool of claim 5, further comprising a top sub defining a top end of the drilling tool and adapted for connection to a drill pipe; wherein the actuator exhaust path vents the actuator exhaust through the top sub; and wherein the flow plate is adapted to be clamped to the drilling tool by attachment of the drill pipe to the housing.

* * * * *

UNITED STATES PATENT AND TRADEMARK OFFICE

CERTIFICATE OF CORRECTION

PATENT NO. : 8,141,663 B2
APPLICATION NO. : 13/183664
DATED : March 27, 2012
INVENTOR(S) : Leland H. Lyon and Warren T. Lay It is certified that error appears in the above-identified patent and that said Letters Patent is hereby corrected as shown below:

Title Page, Col. 1 after "Prior Publication Data" insert:

--Related U.S. Application Data

(63) Continuation of application No. 12/369,579, filed on Feb. 11, 2009, now Pat. No. 8,011,455.--

Col. 1, line 8, insert --now U.S. Pat. No. 8,011,455,-- after "Feb. 11, 2009,"

Signed and Sealed this
Fifteenth Day of May, 2012

David J. Kappos

David J. Kappos
*Director of the United States Patent and Trademark Office*